United States Patent [19]

Noël, deceased et al.

[11] 3,982,365

[45] Sept. 28, 1976

[54] DISTRIBUTION BLOCKS FOR THE FORMATION OF JOINTS RESISTING TO DIFFERENTIAL SETTLING AND JOINTS OBTAINED BY USING SAID BLOCKS

[76] Inventors: Albert D. G. Noël, deceased, late of Brussels, Belgium; by Josette D. Noël, sole heir, 1160 Brussels, Belgium

[22] Filed: June 18, 1975

[21] Appl. No.: 587,984

[52] U.S. Cl. ..... 52/125; 52/396; 404/50; 404/64; 404/67

[51] Int. Cl.[2] ..... E04B 1/62; E01C 11/02

[58] Field of Search ..... 52/396, 125; 404/47, 404/50, 51, 55, 70, 64, 67

[56] References Cited

UNITED STATES PATENTS

| | | | |
|---|---|---|---|
| 2,239,933 | 4/1941 | Robertson | 404/55 |

FOREIGN PATENTS OR APPLICATIONS

| | | | |
|---|---|---|---|
| 1,246,788 | 8/1967 | Germany | 404/50 |
| 1,221,660 | 7/1966 | Germany | 404/50 |
| 554,438 | 1/1957 | Italy | 404/70 |

*Primary Examiner*—Alfred C. Perham
*Attorney, Agent, or Firm*—Bacon & Thomas

[57] ABSTRACT

A distribution block, which comprises a body having a trapezoidal longitudinal section and toothing bars projecting on the said body and extending from an inclined face to the upper face thereof.

3 Claims, 3 Drawing Figures

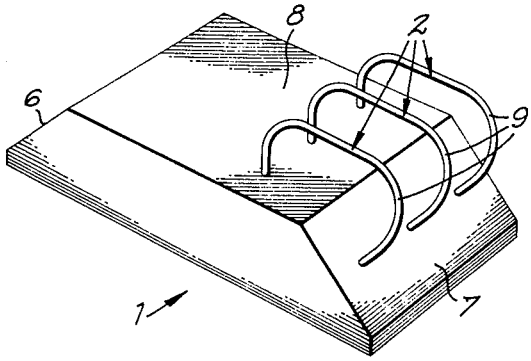
Fig. 1
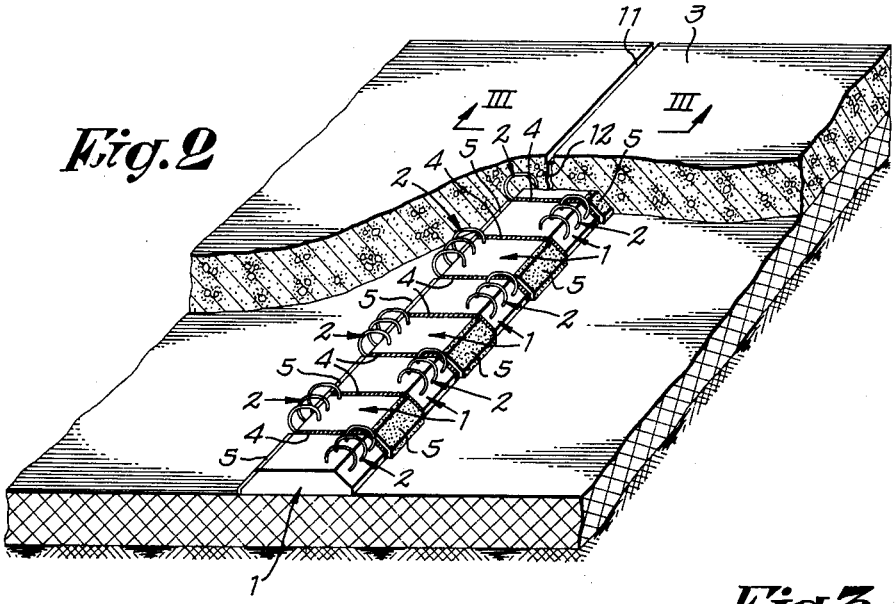
Fig. 2
Fig. 3
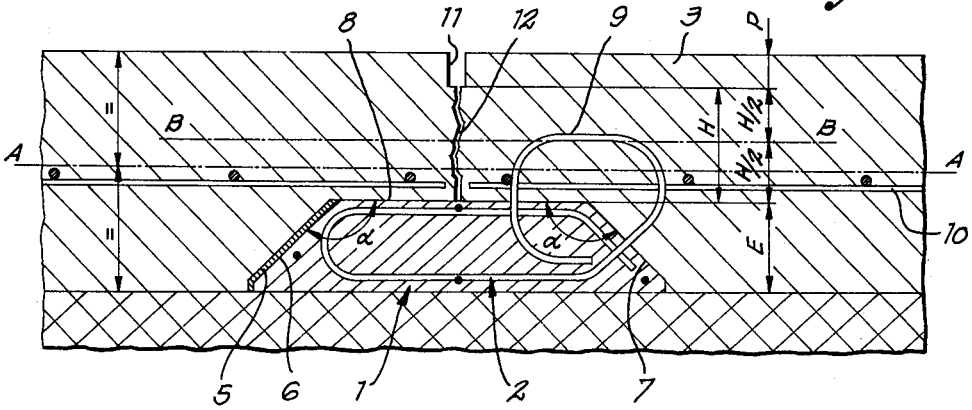

DISTRIBUTION BLOCKS FOR THE FORMATION OF JOINTS RESISTING TO DIFFERENTIAL SETTLING AND JOINTS OBTAINED BY USING SAID BLOCKS

This invention relates to distribution blocks for the formation of joints resisting to differential settling for engineering works such as roads, flying grounds, traffic, parking or storage areas, sluices, tunnels, buildings and similar.

Said blocks according to the invention are constructed so as to obtain important advantages relative to the known distribution blocks.

A first object of this invention is to provide the blocks with a bracing allowing to hold them readily within the mould, thereby facilitating the stripping off and reducing the manufacturing cost.

Another object of this invention is to provide blocks allowing to prevent notch effects in the building area.

Another object of this invention is to form blocks allowing to transmit, into the slabs, a higher bending moment relative to the slabs made with known blocks.

Another object of this invention is to reduce the higher moment through the slab in the regions near the joint.

Another object is to reduce the range between the limits of deformation of the slab at right angles with the joint, thereby alleviating the fatigue near the joint.

Another object lies in the fact that when the slab raises at right angles with the joint, the tangents to the elastic line at right angles with the joint lips are merged and the faces of the joint remain parallel.

Another object lies in the fact that the bracing of the block forms a relay for the bracing of the slab.

Another object lies in the fact that the use of the blocks according to this invention generates a compression stress with an upward eccentricity, which opposes to the bulging under the thermal gradient, while reducing the buckling risk.

The distribution blocks according to this invention allowing to obtain all these advantages comprise a body having a trapezoidal longitudinal section, and toothing bars projecting on the said body and extending from an inclined face to a top face thereof.

The characteristics of the present invention will be more apparent by the following description of a preferred embodiment given by way of example and without any limitation, reference being made to the enclosed drawings in which:

FIG. 1 is a perspective view of a distribution block according to this invention;

FIG. 2 is a perspective view of the constituting parts of an anti-settling joint using blocks such as those represented in FIG. 1;

FIG. 3 shows, on an enlarged scale, a section on the line III—III of FIG. 2.

FIG. 1 shows a perspective view of a distribution block 1 according to the invention. Said block has a trapezoidal shape and it is provided with a bracing consisting namely of three profiled bars 2. Each of said bars forms, on the one hand, the bracing proper of the block, and on the other hand, an outer yoke forming a toothing bar or a gripping element.

Said toothing bars are situated in an upper corner of the trapezoidal body.

Said distribution blocks are aligned as known under the slab 3, a compressible material 4 being interposed between the blocks 1.

The inclined face of the block opposite to the inclined face provided with the said yokes or toothing bars is also provided with a layer 5 of a compressible material.

The faces 6 and 7 of the blocks 1 are inclined so as to form an obtuse angle $\alpha$ with the upper face 8 of the block. By this way, the notch effect within the concrete or the slab 3 is prevented, said effect being always to be feared when the angles $\alpha$ are of 90° or less.

The configuration of the bracing conjugated with the length of the block allows the transmission of a bending moment stretching the upper fiber of the slabs.

This property, on the one hand, reduces the value of the higher moment through the slab in the regions near the joint of about 14% and, on the other hand, it reduces the range between the limits of the deformation of the slab at right angles with the joint. Said reduction of about 17% alleviates the fatigue phenomenon of the concrete near the joint.

The bracing projecting beyond the blocks is so shaped that if forms a relay 9 (covering) with the bracing 10 of the slab 3. The blocks are also more readily handled owing to the presence of said handle-shaped bracings.

Finally, the configuration of the bracing allowing to hold it readily within the mould and facilitating the stripping off after concreting, reduces substantially the manufacturing cost of the blocks.

According to the invention, there is provided, within the slab and above the row of blocks 1, a notch 11 the depth of which will be determined relative to the height or to the thickness of the blocks 1.

Preferably, the limitation of the depth of the said notch will have a value P lower than the thickness E of the blocks 1. By this way, there is left, above the blocks 1, a concrete section having a height H the center of gravity of which is situated on the line B—B, thus above the central axis A—A of the slab 3.

The compression stress generated when the upper slab 3 is expanded to the opening value of the shrinkage crack 12 in the weakened portion of the joint opposes, on the one hand, to the bulging of the slab under the thermal gradient and, on the other hand, it reduces the buckling risk within the slab.

When the slab 3 raises upwardly at right angles with the joint, the tangents to the elastic line on both sides of said joint are always merged. In addition, the faces of the joint remain always parallel with each other whatever the opening of the joint may be; the sealing mass, if any, disposed within said joint is thus subjected to a uniform traction or compression at any point of the sealing mass.

It is apparent that the invention is in no way limited to the embodiment described in the foregoing and illustrated in the enclosed drawings. Any modification may be provided without departing from the scope of the invention.

What I claim is:

1. A distribution block, comprising: a body having a trapezoidal longitudinal section with the small base at the top, and at least one profiled bar having one end thereof embedded in said body and projecting outwardly from an inclined face thereof, the other end of said profiled bar being embedded in said body and projecting upwardly from said small base, the connecting intermediate portion of said bar connecting said ends being disposed above the upper surface of said small base and above the surface of said inclined face, said connecting intermediate portion forming a generally U-shaped gripping element, a substantial portion of which is disposed above said body for handling the block.

2. Distribution block according to claim 1 wherein the profiled bar has a portion perpendicular to the plane of the corresponding inclined face, a portion perpendicular to the upper face of the body, and said connecting portion extends partially parallel with the upper face of said body between said portions.

3. Distribution block according to claim 2, including a plurality of said profiled bars arranged generally parallel to each other with one end of each bar embedded in said body and projecting outwardly from an inclined face thereof and the other end of each bar embedded in said body and projecting upwardly from said small base, at least one end of each of said bars extending transversely across the interior of said body forming interior reinforcing for the block.

* * * * *